US009974996B2

(12) United States Patent
Kiser

(10) Patent No.: US 9,974,996 B2
(45) Date of Patent: May 22, 2018

(54) ADAPTOR FOR AN INDOOR ROWING MACHINE

(71) Applicant: Contrast Optical Design & Engineering, Inc., Albuquerque, NM (US)

(72) Inventor: Willie C. Kiser, Albuquerque, NM (US)

(73) Assignee: Contrast, Inc., Albuquerque, NM (US)

( * ) Notice: Subject to any disclaimer, the term of this patent is extended or adjusted under 35 U.S.C. 154(b) by 57 days.

(21) Appl. No.: 15/191,530

(22) Filed: Jun. 24, 2016

(65) Prior Publication Data

US 2016/0375297 A1 Dec. 29, 2016

Related U.S. Application Data

(60) Provisional application No. 62/254,361, filed on Nov. 12, 2015, provisional application No. 62/183,646, filed on Jun. 23, 2015.

(51) Int. Cl.

| | |
|---|---|
| ***A63B 21/00*** | (2006.01) |
| ***A63B 21/04*** | (2006.01) |
| ***A63B 21/055*** | (2006.01) |
| ***A63B 21/22*** | (2006.01) |
| ***A63B 22/00*** | (2006.01) |
| ***A63B 69/06*** | (2006.01) |

(52) U.S. Cl.

CPC ..... *A63B 22/0076* (2013.01); *A63B 22/0087* (2013.01); *A63B 69/06* (2013.01); *A63B 21/0428* (2013.01); *A63B 21/0552* (2013.01); *A63B 21/154* (2013.01); *A63B 21/225* (2013.01); *A63B 2022/0079* (2013.01); *A63B 2022/0084* (2013.01); *A63B 2069/062* (2013.01); *A63B 2069/064* (2013.01); *A63B 2225/093* (2013.01)

(58) Field of Classification Search

CPC ..... A63B 22/0076–2022/0084; A63B 21/154; A63B 21/225; A63B 69/06–2069/066

See application file for complete search history.

(56) References Cited

U.S. PATENT DOCUMENTS

| | | | | |
|---|---|---|---|---|
| 4,396,188 | A | 8/1983 | Dreissigacker et al. | |
| 4,743,011 | A | 5/1988 | Coffey | |
| 5,092,581 | A | 3/1992 | Koz | |
| 5,707,322 | A | 1/1998 | Dreissigacker et al. | |
| 7,731,637 | B2 | 6/2010 | D'Eredita | |
| 8,622,876 | B2 | 1/2014 | Kelliher | |
| 2009/0181832 | A1* | 7/2009 | Bell | A63B 21/154 482/72 |
| 2011/0028278 | A1 | 2/2011 | Roach | |
| 2011/0172034 | A1* | 7/2011 | Sidley | A63B 69/002 473/446 |

FOREIGN PATENT DOCUMENTS

| | | | |
|---|---|---|---|
| WO | 2005025685 | A1 | 3/2005 |

* cited by examiner

*Primary Examiner* — Loan H Thanh
*Assistant Examiner* — Jennifer M Deichl
(74) *Attorney, Agent, or Firm* — Brown Rudnick LLP; Thomas C. Meyers

(57) ABSTRACT

A rowing machine can include a frame, a seat movably attached to the frame, the seat being configured to slide horizontally along the frame, a flywheel rotatably mounted to an end of the frame, a cable having a free end and an end attached to the flywheel, and an adapter assembly for compatibility with multiple oar or handle configurations.

11 Claims, 9 Drawing Sheets

ADAPTOR FOR AN INDOOR ROWING MACHINE

CROSS-REFERENCE TO RELATED APPLICATIONS

The present application is related to and claims priority pursuant to 35 U.S.C. § 119 to U.S. Ser. No. 62/183,646 (filed Jun. 23, 2015) and to U.S. Ser. No. 62/254,361 (filed Nov. 12, 2015), the contents of which are each incorporated herein by reference in their entirety.

TECHNOLOGICAL FIELD

This disclosure relates to an adapter for an indoor rowing machine.

BACKGROUND

A rowing machine is typically used to improve rowing techniques and/or the general fitness of a rower. A conventional rowing machine includes a sliding seat attached to a seat rail and a handle attached to a resistance device. One example of a conventional rowing machine is the Indoor Rower from Concept 2, Inc. of Vermont, which is the current "standard" within the rowing community. It offers users a relatively affordable, space-efficient, and lightweight design. The Concept 2® Rower operates by the user pulling the handle away from the flywheel. The handle is connected to the flywheel via a chain and a clutching sprocket mechanism.

On the water, rowing is commonly categorized as either sculling or sweeping. Two-oar rowing or sculling is a form of rowing in which a boat is propelled by one or more rowers, each of whom operates two oars. In sweep or sweep-oar rowing, a rower has one oar typically held with both hands. Unfortunately, a rowing machine is not always compatible with a rower's preferred rowing form.

SUMMARY

The inventive adapter and/or adapter kit converts a conventional rowing machine to a versatile rowing machine that is compatible with rowing forms, namely, both sweeping and sculling. When a conventional rowing machine is retrofitted with the inventive adapter or adapter kit, a rower can quickly switch between rowing with a single handle (e.g., sweeping) and rowing with two oars (e.g., sculling). This retrofitting is even accomplished with minimal modifications to the conventional rowing machine.

Because a conventional rowing machine modified by such an adapter or adapter kit (a modified rowing machine) is compatible with more rowing styles, a rower can practice or exercise using their selected rowing form. If a rower currently owns a conventional rowing machine, the adapter broadens the capabilities of their current machine without requiring that the machine is replaced or supplemented with an additional machine. This flexibility is desirable in both personal and commercial markets, and the adapter is similarly well suited and compatible with personal and commercial rowing machines.

In some cases, a resistance device of a conventional rowing machine is used in a stroke training device, as described in U.S. Pat. No. 8,622,876. These machines generally requires more space than a modified rowing machine and fail to offer the same versatility and features. For example, these stroke training devices are not designed to transition between a two-oar configuration and the original (single) handle configuration of the conventional rowing machine.

Implementations can include one or more advantages. For example, a user can practice controlling the oar height through the stroke as the modified rowing machine allows a full range of vertical motion in the oar. Yet, a conventional rowing machine modified with an adapter (as described throughout this application) remains compact and similar in size to a conventional rowing machine.

Beyond providing a rower with an alternative rowing form, the adapter has a minimal impact on the rowing experience. That is, the seat, slide, foot supports, and other common accessories of a conventional rowing machine are unaffected by the adapter. This consistency enhances the rowing experience and helps a rower to transition seamlessly between each of the rowing forms.

The adapter is also compatible with ergometers typically found on conventional rowing machines without requiring reprograming of the ergometer. In other words, the ergometer will continue to detect meaningful data for sculling and sweeping workouts on a modified rowing machine. This compatibility helps support seamless and simple transitions between rowing configurations.

As used herein, the term "conventional rowing machine" refers to a rowing machine having a seat rail and a handle connected to a flywheel or resistance device. Examples of conventional rowing machines include Models C, D, and/or E of indoor rowers by Concept 2®, which each includes a handle connected to a flywheel via a chain.

In one aspect of the invention, an adapter for a rowing machine, the adapter including a pair of arms pivotably mounted to one or more supporting members and connected to each other by a cable; a block including a channel and at least one pulley, the block being configured to mount on a rowing machine, and a housing comprising a horizontal track, a carriage mounted on the track and connected to the cable, the carriage being configured to move horizontally along the track in response a movement of the pair of arms.

In another aspect of the invention, a rowing machine including a rail connected to a front end; a seat movably attached to the rail; a flywheel rotatably mounted to the front end; a chain having a free end and an end attached to the flywheel; a block mounted between the rail and the front end, the block comprising a channel extending below the rail and at least one pulley, wherein the free end of the chain is supported by the pulley and passes through the channel; and an adapter assembly. The adapter assembly includes a horizontal track, a carriage mounted on the horizontal track and connected to the cable, the carriage being configured to move horizontally along the track in response movement from both of the arms.

In yet another aspect of the invention, a method for retrofitting a rowing machine includes attaching a block having a channel to a rail of a rowing machine, attaching a pair of arms and supporting members to a frame of the rowing machine, the pair of arms being pivotably mounted to one or more supporting members and connected to each other by a cable; removing the handle from the chain; attaching an adapter assembly to the frame below the rail; and attaching the chain to the transfer carriage. The rowing machine includes a frame; a seat movably attached to the rail, a flywheel rotatably mounted to a front end, a chain having an end attached to the flywheel and an end removably attached to a handle. The adapter assembly includes a horizontal track, and a carriage mounted on the horizontal track and connected to the cable, the carriage being configured to move along the track in response to movement of the pair of arm. In another aspect of the invention, an adapter kit for retrofitting a rowing machine includes a pair of arms pivotably mounted to one or more supporting members and connected to each other by a cable; a housing; and instructions for connecting the arms, housing, and block to a rowing machine such that the arms are removably connected to a flywheel by a quick release connection. The housing includes a horizontal track, a carriage mounted on the track and connected to the cable, the carriage being configured to move horizontally along the track in response movement of the pair of arms; and a block comprising a channel and at least one pulley, the block being configured to mount on a rowing machine.

Implementations can include one or more of the following features. The arms are oars. The supporting members are outriggers. The adapter further includes a swivel connector mounted on an end of each of the oars and attached to the cable, the swivel connector being configured to align the cable as each oar moves. The block is configured to mount on a rail of a conventional rowing machine. The housing further includes at least two pulleys attached to an inner surface of the housing and a bungee cord passing through each of the pulleys, a first end of the bungee cord being attached or fixed to the inner surface and a second end being attached to the carriage. The rowing machine further includes a pulley through which the cable passes, the carriage being connected to the cable through the pulley. The carriage is connected to the cable, and the cable passes through a pulley, where the pulley is connected to the carriage by a second cable. The rowing machine further includes a platform connected to the frame, the connection being configured so that the frame moves along the horizontal axis of the platform. The carriage is connected to the cable and the cable passes through a pulley and the pulley is connected to the carriage by a second cable.

These and other aspects, features, and implementations, and combinations of them, may be expressed as apparatus, methods, means or steps for performing functions, kits, components, systems, program products, and in other ways.

Other aspects, features, and advantages will be apparent from the description and drawings, and from the claims.

BRIEF DESCRIPTION OF THE DRAWINGS

Features and advantages of the claimed subject matter will be apparent from the following detailed description of embodiments consistent therewith, which description should be considered with reference to the accompanying drawings.

For a thorough understanding of the present disclosure, reference should be made to the following detailed description, including the appended claims, in connection with the above-described drawings. Although the present disclosure is described in connection with exemplary embodiments, the disclosure is not intended to be limited to the specific forms set forth herein. It is understood that various omissions and substitutions of equivalents are contemplated as circumstances may suggest or render expedient.

DETAILED DESCRIPTION

Figure 1:
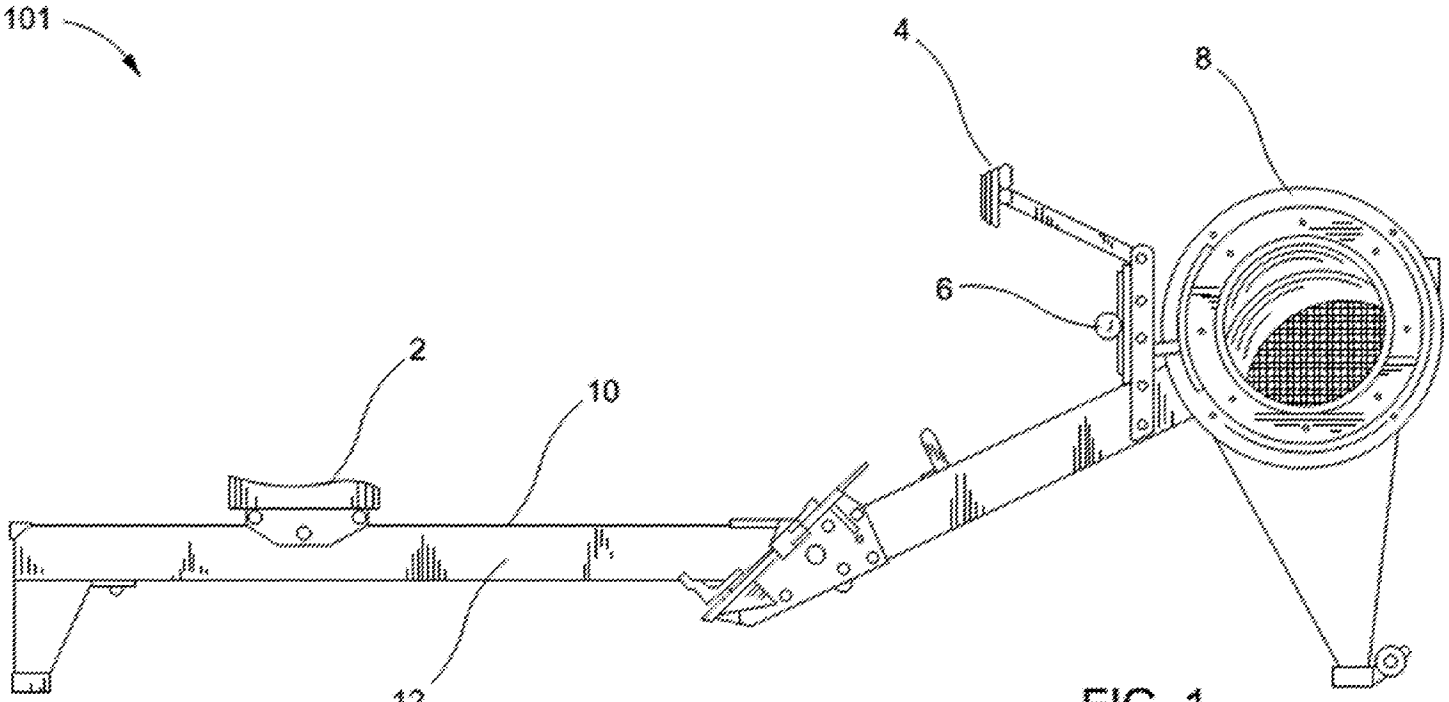
FIG. 1 Prior Art
FIG. 1 shows a conventional rowing machine according to the prior art.

The present disclosure relates to an adapter that transforms a conventional rowing machine (e.g., a Concept 2® indoor rowing machine model C, D, or E) into a rowing machine capable of switching between a single handle and a two-oar configuration. Installation of this adapter includes minimal modifications to a conventional rowing machine and enables a user to quickly switch between a single oar rowing motion and a two-oar rowing motion. FIG. 1 shows a conventional rowing machine of the prior art including a seat 2 mounted on a track 10 of a rail 12, a handle 6 connected to a flywheel 8, a monitor 4 for displaying rowing related metrics.

Figure 2:
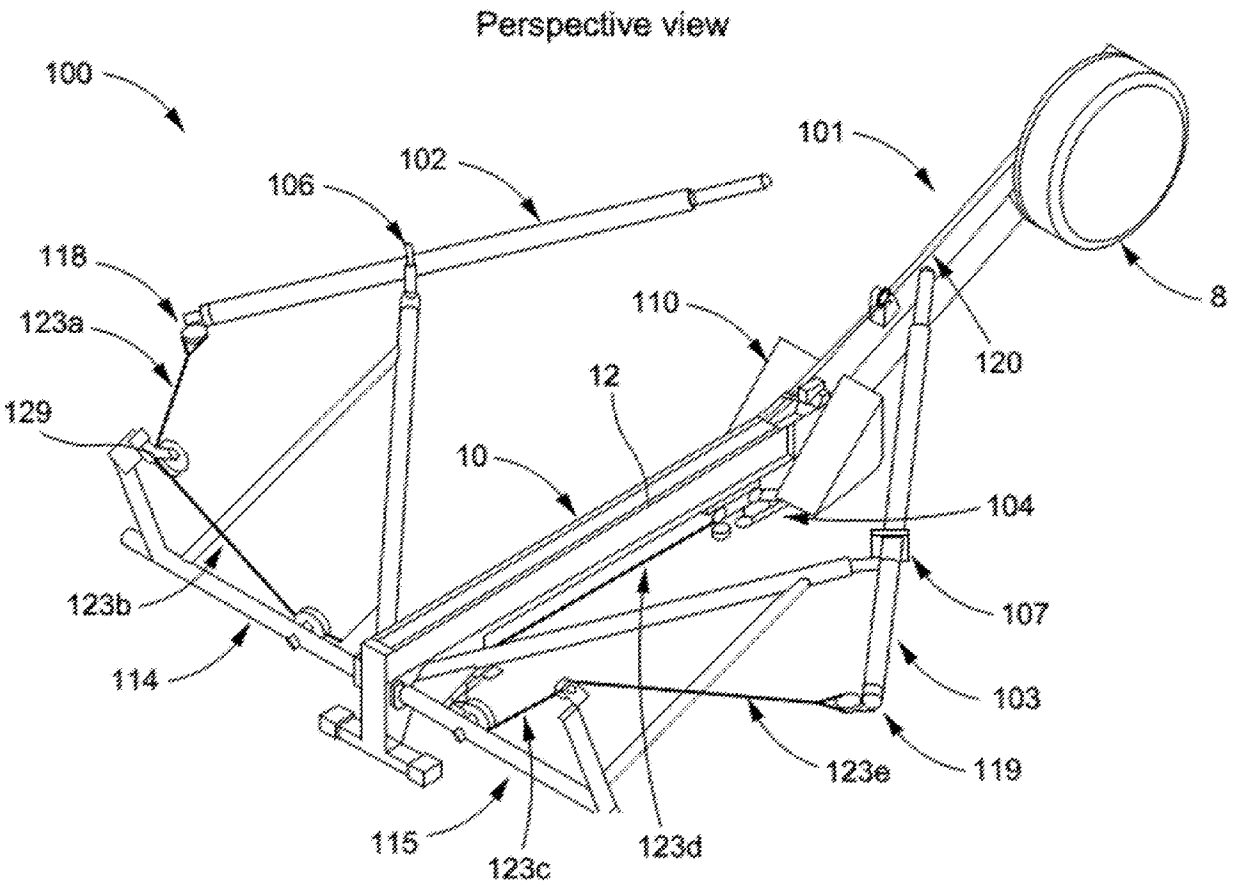
FIG. 2 shows an adapter attached to a conventional rowing machine, the adapter including outriggers, oars, oar locks, a power transfer carriage, cables, and pulleys.

FIG. 2 shows an adapter 100 attached to a conventional rowing machine 101. For clarity, the seat 2 and the monitor 4 are not shown. The adapter 100 includes outriggers 114,115 attached to the rail 12 of the conventional rowing machine 101, a pair of oars 102, 103, adapter oar locks 106, 107, a power transfer carriage 104 attached to a support track (not shown), and a series of cable segments 123-126 running through a series of pulleys 129.

The adapter 100 uses a master link in the original chain 120, which provides the ability to quickly switch between sculling simulation (two separate oars) and the standard single-handle rowing machine configuration.

The adapter 100 uses two oars 102, 103 cut down to a specified length with a specially designed adapter 118, 119 placed into the cut-off end of each oar 120, 103. The adapter 100 also allows the user the full range of motion within the sculling stroke and transfers the energy of the user's stroke back into the chain 120 (also referred to as a pull chain) of the conventional rowing machine 101 through a heavy gauge vinyl coated steel cable. Because the adapter 100 uses the sculling oarlocks 106, 107, it provides the user the experience of having to control the oar height throughout the stroke and allows the full range of vertical motion in the oar, which further simulates the action of real sculling.

The heavy gauge steel cable allows the smooth range of motion of the oars and maintains a tight connection to the chain 120 through a series of pulleys 129, to direct the cable, and the power transfer carriage 104 located underneath the rail 12. The cable's ends are tied each to one of the oars 102, 103 so that the user must maintain pressure on each oar 102, 103 evenly throughout the stroke to pull the chain 120 of the conventional rowing machine 101.

In some cases, the adapter 100 uses conventional sculling oars and oarlocks, however, these components may also be customized. For example, the length of the oar can be adjusted based on a rower's preference. In other cases, the oarlock may be selected to further restrain or free the movement of the oars during use.

FIG. 2 also shows the path of the cable through the pulleys 129 of the adapter 100 to transfer the energy to the chain 120 of the conventional rowing machine 101. The power transfer carriage 104 uses a 2:1 mechanical disadvantage setup when pulling the chain 120. This mechanical disadvantage is offset by the 2:1 mechanical advantage conferred by the oars' pivot points.

Figure 3:
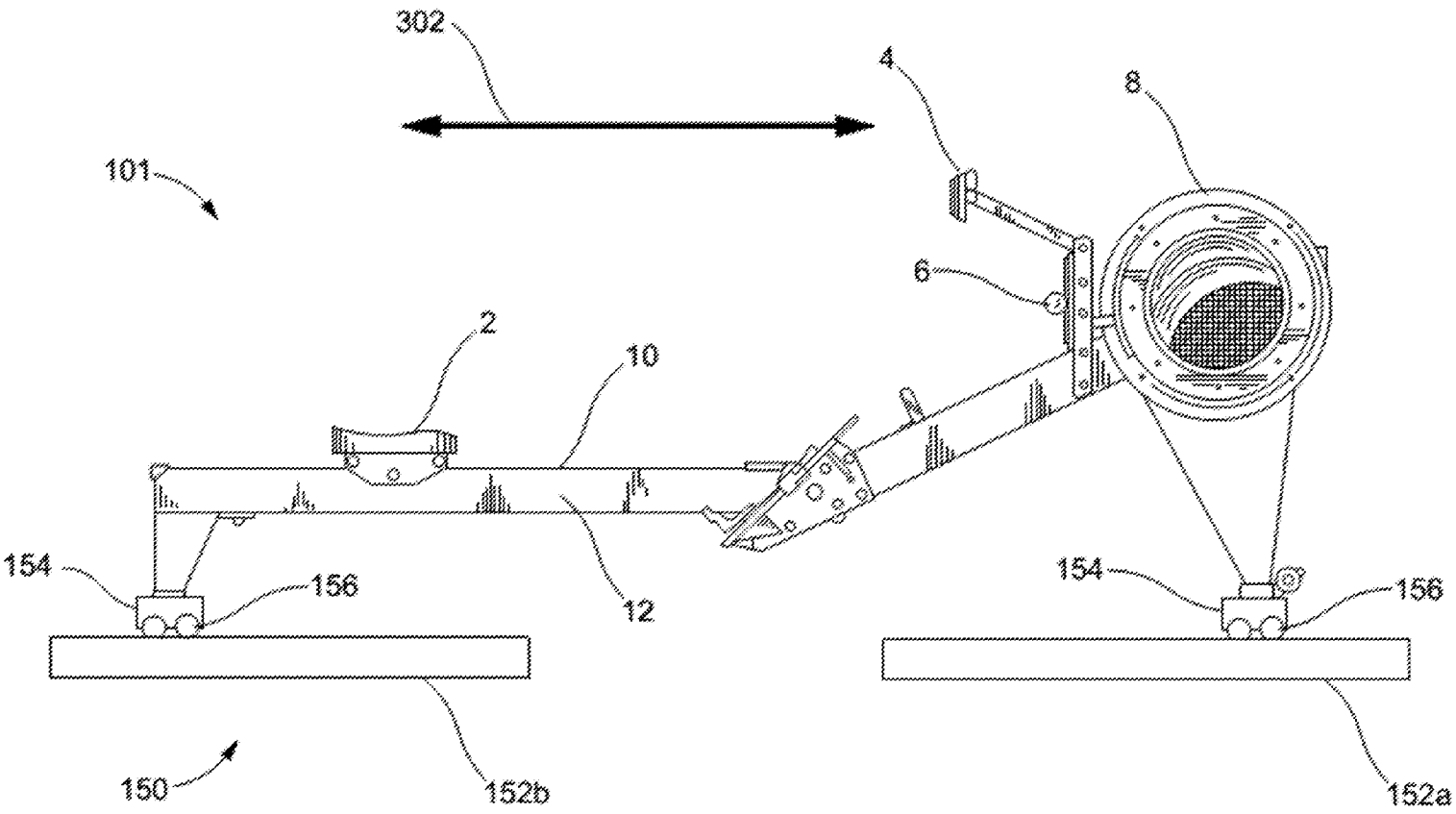
FIG. 3 shows a conventional rowing machine on a platform.
Figure 4:
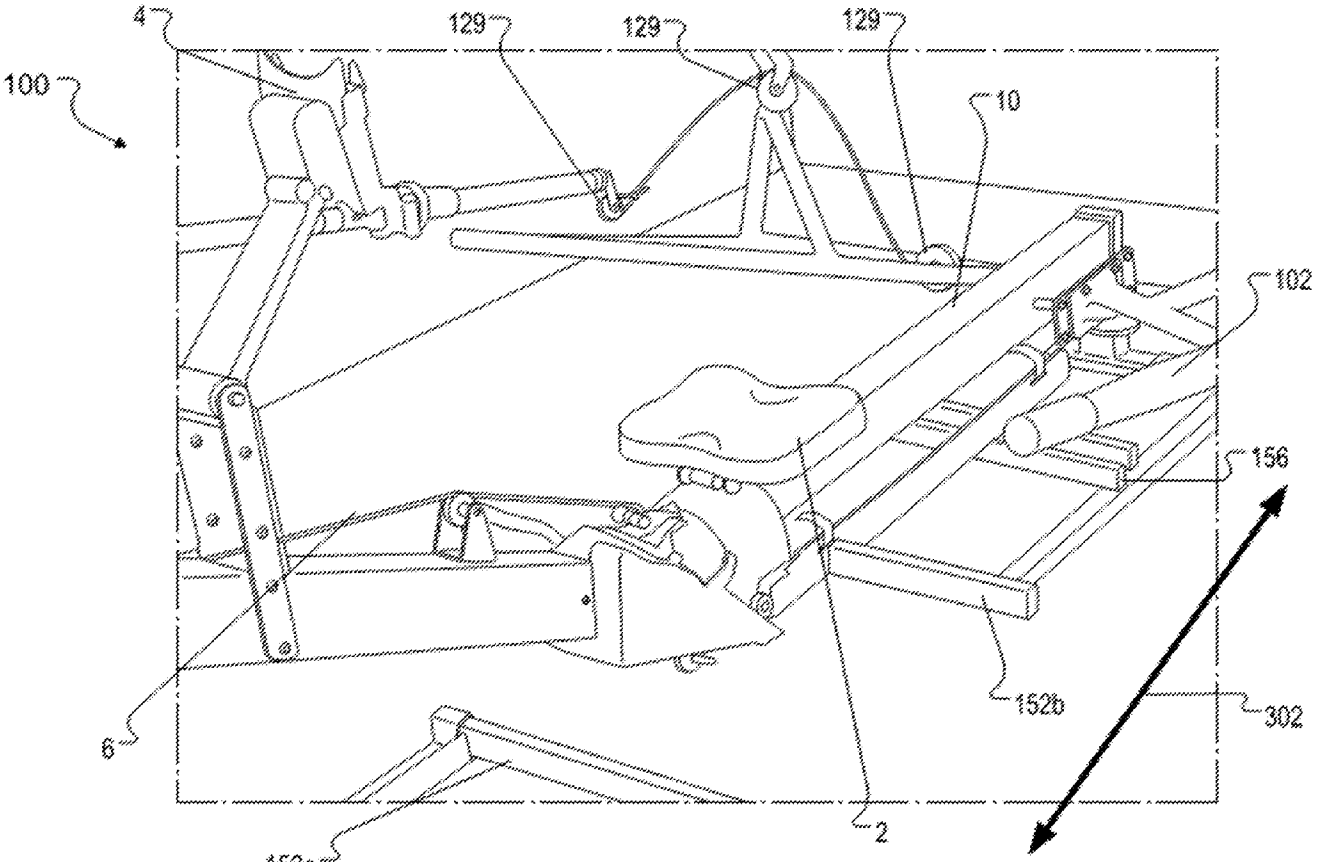
FIG. 4 shows a partial view of the adapter installed on a conventional rowing machine.

FIG. 3 and FIG. 4 show a conventional rowing machine 101 attached to a platform 152*a*, 152*b* using one or more rollers. This connection on the platform 152*a*, 152*b* allows the machine to move horizontally in directions generally indicated by an arrow 302.

Figure 5:
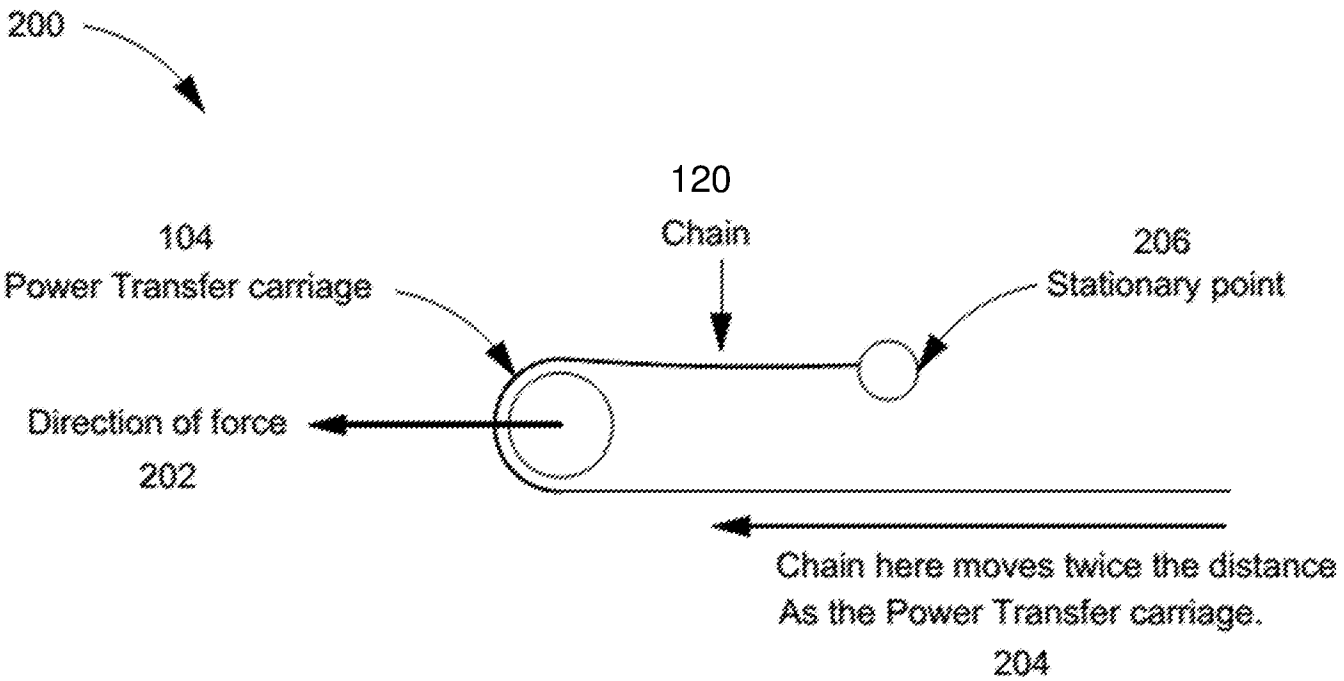
FIG. 5 shows a simplified representation of the movement direction and forces applied to a power transfer carriage.

FIG. 5 shows a simple representation of how the power transfer carriage 104 is used. The cable (123-126) pulled by the oars 102, 103 pulls the power transfer carriage 104 to the left of the image along the direction of force. However, one end of the chain 120 is stationary so that for every 1 inch of movement of the power transfer carriage 104 to the left there are 2 inches of chain 120 pull. This mechanical disadvantage is directly offset by the choice of the pivot point (oarlock interface) location on the oars 102, 103. The portion of the oar 102, 103 that is outboard of the oarlock is roughly half the length of the inboard portion center on the oar's pivot point, giving the oar 102, 103 a 2:1 mechanical advantage and thus canceling out the disadvantage of the power transfer carriage 104. This setup allows a more compact design of the oars 102, 103 and the power transfer carriage 104, and still maintains about a 1:1 connection between the distance the oar handle moves and the amount the chain 120 moves. This maintains the same amount of total energy required for the same distance and speed of pull-chain movement, as compared to the original (unaltered) conventional rowing machine 101 single-handle rowing machine configuration.

Figure 6:
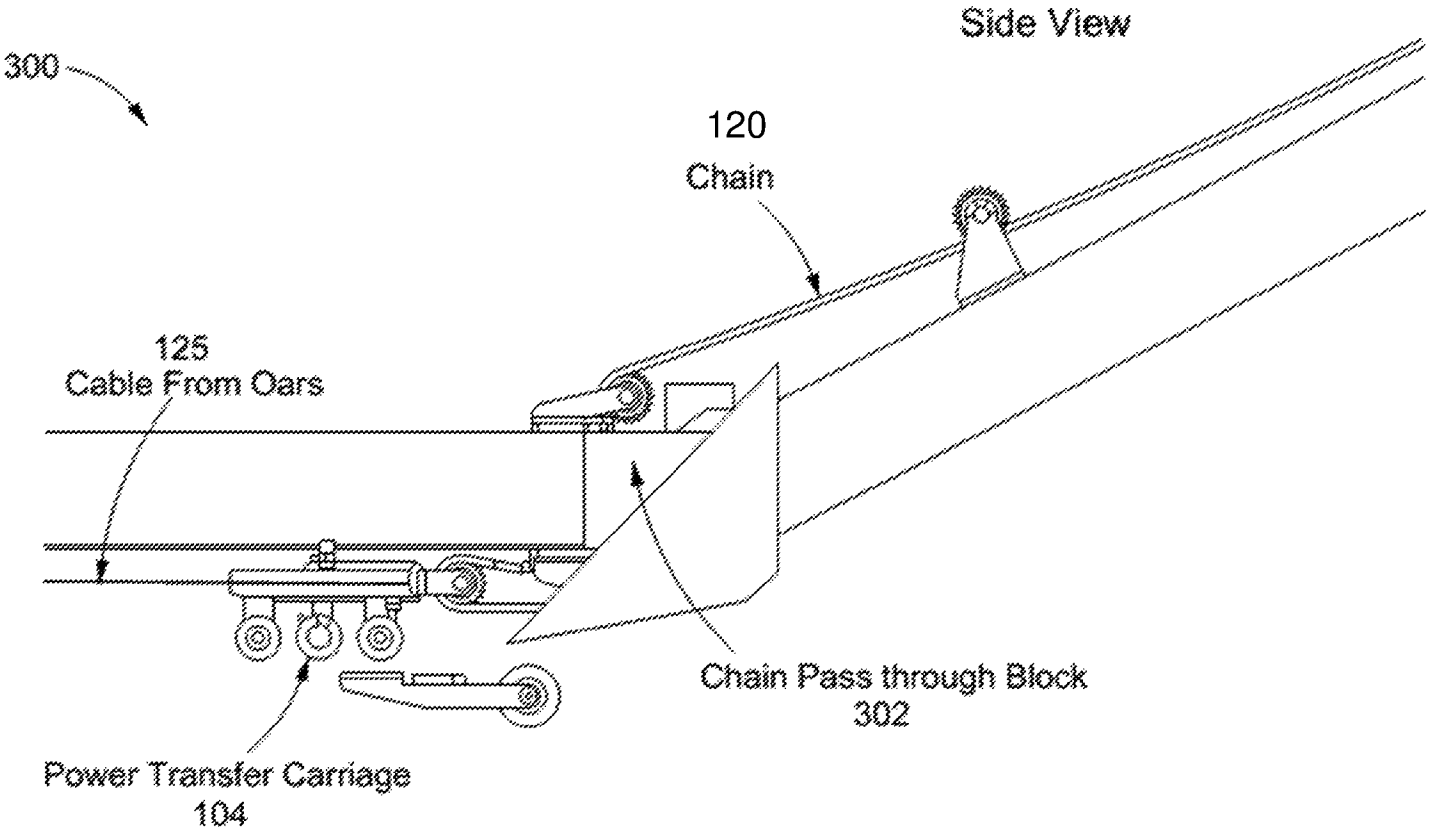
FIG. 6 shows a power transfer carriage connected to the chain of a conventional rowing machine.

FIG. 6 shows the power transfer carriage 104 and its connection to the original Concept 2's® chain 120. The chain 120 is lengthened via the master link and directed through the slide using a chain block 302. The chain block 302 is a 4-inch rail extension that is bolted to the existing rail 12 of the conventional rowing machine 101. The chain block 302 provides a through-the-rail path for the chain 120 (and chain extension) to pass to the underneath power transfer carriage 104. The power transfer carriage 104 is mounted on its rail system to keep it aligned and engaged with the user and the pull-chain system. This engagement and alignment helps to provide a smooth stroke and recovery movement to a user.

Figure 7:
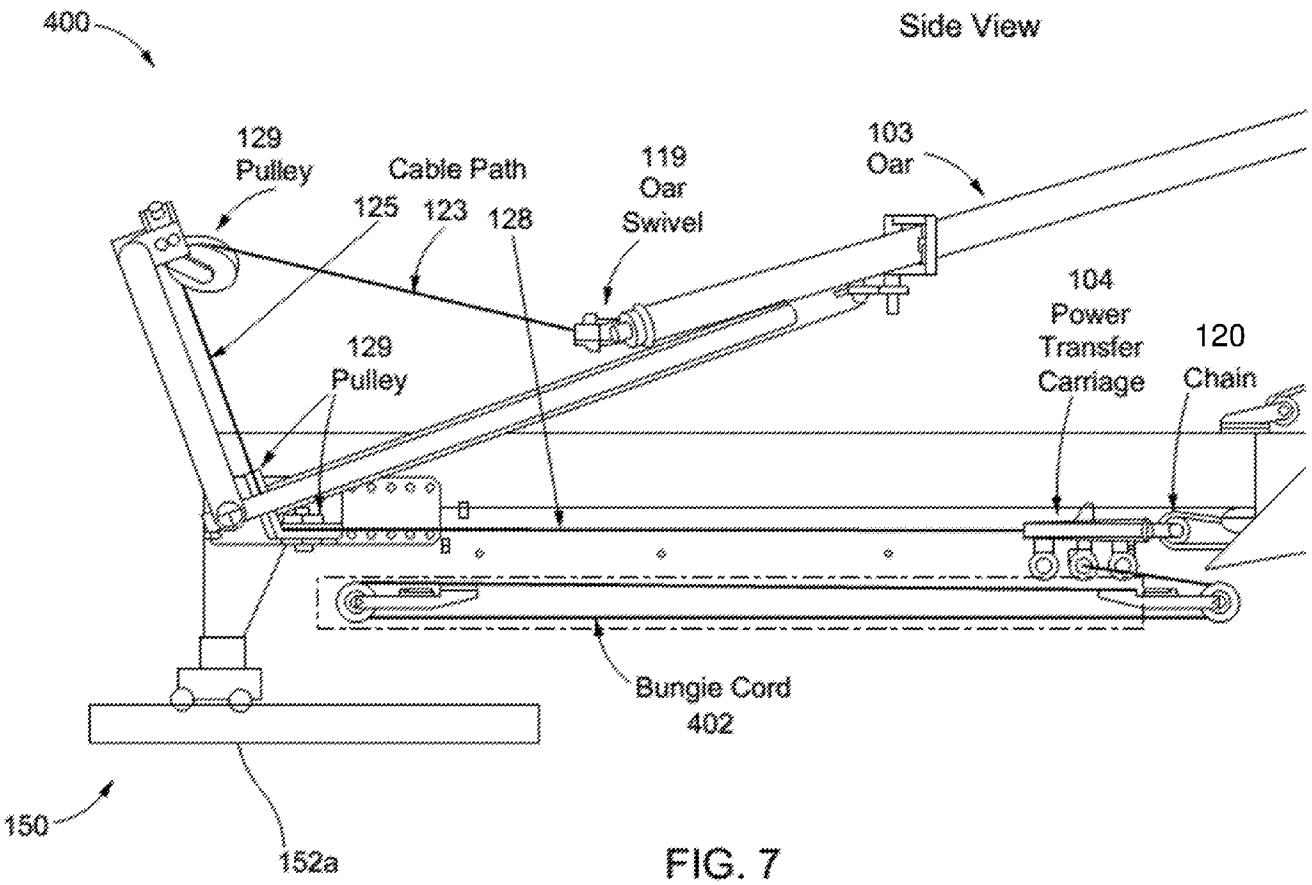
FIG. 7 shows a side view of the adapter of FIG. 2 including a path of a cable connecting the oar to the power transfer carriage through multiple pulleys.
Figure 8:
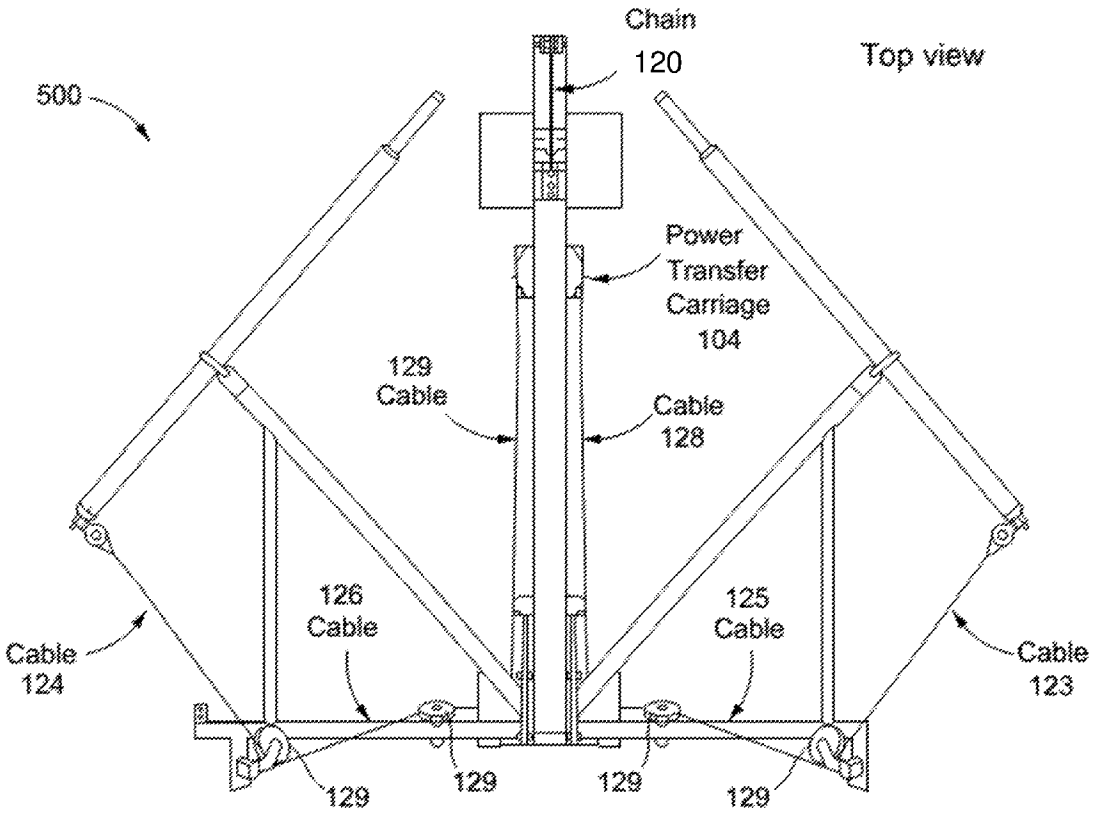
FIG. 8 shows a top down view of the adapter components of FIG. 2 including a path of a cable connecting the oar to the power transfer carriage through multiple pulleys.

FIG. 7 shows a side view of the adapter 100, which shows the path that the cable 123,125, 128 follows connecting the oar swivel 119 to the power transfer carriage 104 through the system of director pulleys 129. The power transfer carriage 104 additionally has a bungee cord system 402, which keeps tension on the cable 123,125, 128 and helps the power transfer carriage 104 return to its starting position during the rowing stroke recovery phase. FIG. 8 shows a top down view of the adapter components and the path of the steel cable through the system.

Figure 9A:
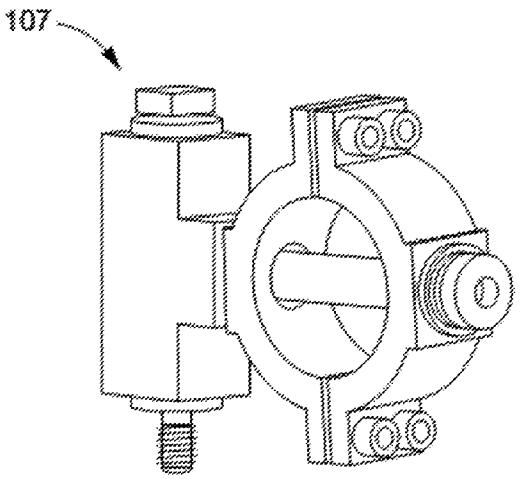
FIGS. 9A and 9B show an oarlock in isolation and attached to the oar.
Figure 9B:
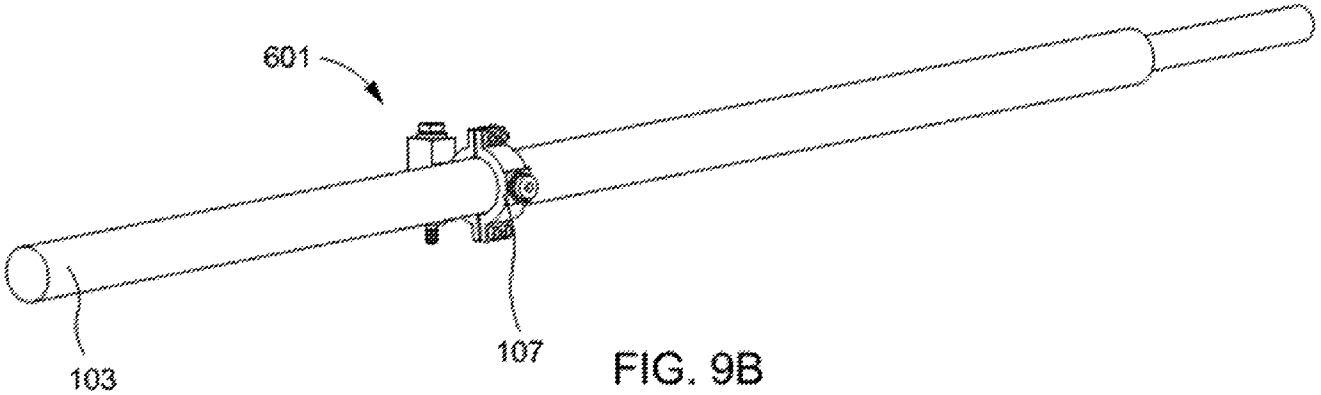

FIGS. 9A and 9B show the oar locks 106, 107 used on the adapter. In particular, FIG. 9A shows the oarlock in isolation to highlight show 2 degrees of freedom required, and FIG. 9B shows the oar lock 107 installed on the oar 106.

INCORPORATION BY REFERENCE

References and citations to other documents, such as patents, patent applications, patent publications, journals, books, papers, web contents, have been made throughout this disclosure. All such documents are hereby incorporated herein by reference in their entirety for all purposes.

EQUIVALENTS

Various modifications of the invention and many further embodiments thereof, in addition to those shown and described herein, will become apparent to those skilled in the art from the full contents of this document, including references to the scientific and patent literature cited herein. The subject matter herein contains important information, exemplification, and guidance that can be adapted to the practice of this invention in its various embodiments and equivalents thereof.

What is claimed is:

1. An adapter for a rowing machine, the adapter comprising:

a pair of arms pivotably mounted to one or more supporting members and connected to each other by a cable;

a housing comprising:

a horizontal track, a carriage mounted on the track and connected to the cable, the carriage being configured to move horizontally along the track in response a movement of the pair of arms; and a block comprising a channel and at least one pulley, the block being configured to mount on a rowing machine, wherein the carriage is connected to the cable and the cable passes through a pulley and the pulley is connected to the carriage by a second cable.

2. An adapter for a rowing machine, the adapter comprising:

a pair of arms pivotably mounted to one or more supporting members and connected to each other by a cable;

a housing comprising:

a horizontal track, a carriage mounted on the track and connected to the cable, the carriage being configured to move horizontally along the track in response a movement of the pair of arms; and a block comprising a channel and at least one pulley, wherein the block is configured to mount on a rail of a conventional rowing machine.

3. An adapter for a rowing machine, the adapter comprising:

a pair of arms pivotably mounted to one or more supporting members and connected to each other by a cable;

a housing comprising:

a horizontal track, a carriage mounted on the track and connected to the cable, the carriage being configured to move horizontally along the track in response a movement of the pair of arms; and a block comprising a channel and at least one pulley, wherein the housing further comprises at least two pulleys attached to an inner surface of the housing and a bungee cord passing through each of the pulleys, a first end of the bungee cord being attached to the inner surface and a second end being attached to the carriage.

4. A rowing machine comprising:

a pair of arms pivotably mounted to one or more supporting members and connected to each other by a cable;

a rail connected to a front end;

a seat movably attached to the rail;

a flywheel rotatably mounted to the front end;

a chain having a free end and an end attached to the flywheel;

a block mounted between the rail and the front end, the block comprising a channel extending below the rail and at least one pulley, wherein the free end of the chain is supported by the pulley and passes through the channel; and an adapter assembly comprising:

a horizontal track, a carriage mounted on the horizontal track and connected to the cable, the carriage being configured to move horizontally along the track in response movement from both of the arms.

5. The rowing machine of claim 4, further comprising a pulley through which the cable passes, the carriage being connected to the cable through the pulley.

6. The rowing machine of claim 4, wherein the carriage is connected to the cable, and the cable passes through a pulley, wherein the pulley is connected to the carriage by a second cable.

7. The rowing machine of claim 4, wherein the arms are oars.

8. The rowing machine of claim 4, further comprising a swivel connector mounted on an end of each of the arms and attached to the cable, the swivel connector being configured to align the cable as each arm moves.

9. The rowing machine of claim 4, wherein the block is configured to mount on a rail of a conventional rowing machine.

10. The rowing machine of claim 4, wherein a height of the block is adjustable.

11. A method for retrofitting a rowing machine, the method comprising:

attaching a block having a channel to a rail of a rowing machine, the rowing machine comprising:

a frame;

a seat movably attached to the rail, a flywheel rotatably mounted to a front end, a chain having an end attached to the flywheel and an end removably attached to a handle; and attaching a pair of arms and supporting members to a frame of the rowing machine, the pair of arms being pivotably mounted to one or more supporting members and connected to each other by a cable;

removing the handle from the chain;

attaching an adapter assembly to the frame below the rail, the adapter assembly comprising:

a horizontal track, and a carriage mounted on the horizontal track and connected to the cable, the carriage being configured to move along the track in response to movement of the pair of arms; and attaching the chain to the transfer carriage.

* * * * *